US012789068B2

(12) United States Patent
Kostomlatský

(10) Patent No.: US 12,789,068 B2
(45) Date of Patent: Nov. 10, 2026

(54) SCULLING SIMULATOR

(71) Applicant: ROWINGO s.r.o., Ústí nad Labem (CZ)

(72) Inventor: Matou Kostomlatský, Ústí nad Labem (CZ)

(73) Assignee: ROWINGO s.r.o., Ústí nad Labem (CZ)

( * ) Notice: Subject to any disclaimer, the term of this patent is extended or adjusted under 35 U.S.C. 154(b) by 39 days.

(21) Appl. No.: 18/881,844

(22) PCT Filed: Jul. 13, 2023

(86) PCT No.: PCT/CZ2023/050041
§ 371 (c)(1),
(2) Date: Jan. 7, 2025

(87) PCT Pub. No.: WO2024/012613
PCT Pub. Date: Jan. 18, 2024

(65) Prior Publication Data

US 2025/0235768 A1 Jul. 24, 2025

(30) Foreign Application Priority Data

Jul. 14, 2022 (CZ) ..... CZ2022-308

(51) Int. Cl.
*A63B 69/06* (2006.01)
*A63B 21/015* (2006.01)
*A63B 22/00* (2006.01)

(52) U.S. Cl.
CPC ..... *A63B 69/06* (2013.01); *A63B 21/015* (2013.01); *A63B 22/0087* (2013.01); *A63B 2225/093* (2013.01)

(58) Field of Classification Search
CPC ... A63B 69/06; A63B 21/015; A63B 22/0087; A63B 2225/093; A63B 2069/064;
(Continued)

(56) References Cited

U.S. PATENT DOCUMENTS

D367,508 S 2/1996 Dreissigacker et al.
5,779,600 A 7/1998 Pape
(Continued)

FOREIGN PATENT DOCUMENTS

DE 20 2011 103 381 U1 9/2011
EP 2 545 965 A2 1/2013
(Continued)

OTHER PUBLICATIONS

International Search Report in PCT/CZ2023/050041, mailed Oct. 6, 2023.
(Continued)

*Primary Examiner* — Andrew S Lo
(74) *Attorney, Agent, or Firm* — Collard & Roe, P.C.

(57) ABSTRACT

A sculling simulator includes a base, a slide rail to which a foot stretcher is adjustably mounted and a movable seat is mounted, a pair of wings attached on their front side to the base of the simulator, with an oar pivotally attached to each of the wings on the other side, each oar being connected by its own gearbox to its own resistance fan, allowing realistic training of the movements used in a real rowing boat.

15 Claims, 3 Drawing Sheets

(58) Field of Classification Search
CPC ..... A63B 2210/50; A63B 2225/09; A63B 2069/066; A63B 21/0088; A63B 21/159; A63B 21/225; A63B 2022/0084
See application file for complete search history.

(56) References Cited

U.S. PATENT DOCUMENTS

| | | | | |
|---|---|---|---|---|
| 7,862,484 | B1 * | 1/2011 | Coffey | A63B 21/157 482/72 |
| 2006/0270528 | A1 | 11/2006 | Lai | |
| 2008/0305934 | A1 | 12/2008 | Medina | |
| 2009/0181832 | A1 | 7/2009 | Bell | |
| 2011/0245044 | A1 | 10/2011 | Kelliher | |
| 2018/0056118 | A1 * | 3/2018 | Bates | A63B 22/0087 |
| 2020/0023232 | A1 * | 1/2020 | French | A63B 22/0076 |
| 2023/0067732 | A1 * | 3/2023 | Neuhaus | A63B 21/154 |

FOREIGN PATENT DOCUMENTS

| | | | |
|---|---|---|---|
| WO | 97/22389 | A1 | 6/1997 |
| WO | 2014/179866 | A1 | 11/2014 |
| WO | 2014/196870 | A1 | 12/2014 |

OTHER PUBLICATIONS

Czech Republic Search Report dated Dec. 15, 2022, in Czech Republic Application No. PV 2022-308.

Bohuslav, Tomáš. Současné veslařské trenažéry se jim zdály nepraktické, a tak čeští studenti vyvinuli vlastní. Nadšený je z něj i mistr světa Synek, (The current rowing machines seemed impractical to them, so Czech students developed their own. World champion Synek is also excited about him), May 9, 2022 [online] [retrieved on Dec. 14, 2022]. Retrieved from <https://www.euro.cz/clanky/soucasne-veslarsketrenazery-se-jim-zdaly-neprakticke-a-tak-cesti- studenti-vyvinulivlastni-nadseny-je-z-nej-i-mistr-sveta-synek/>, with English translation.

* cited by examiner

[Fig. 1]
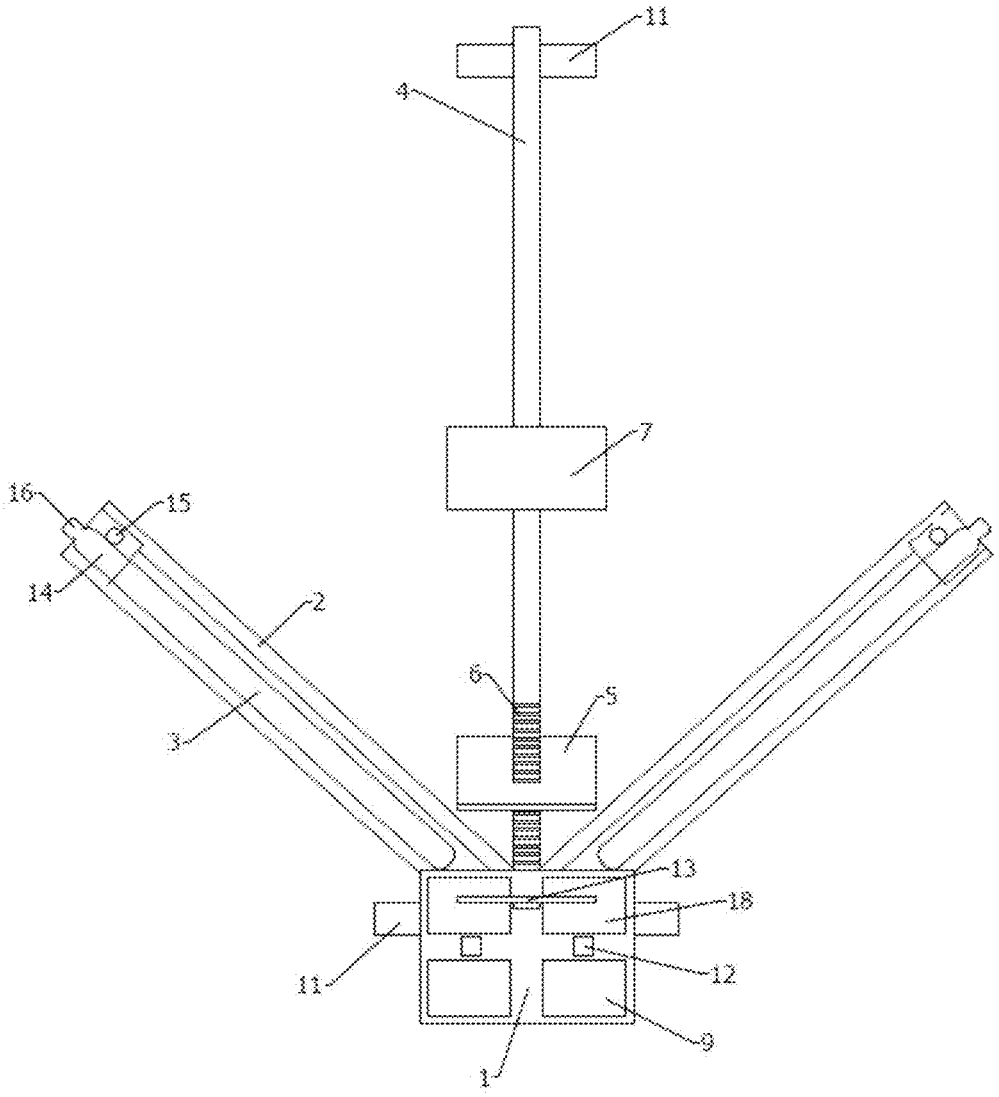
[Fig. 2]
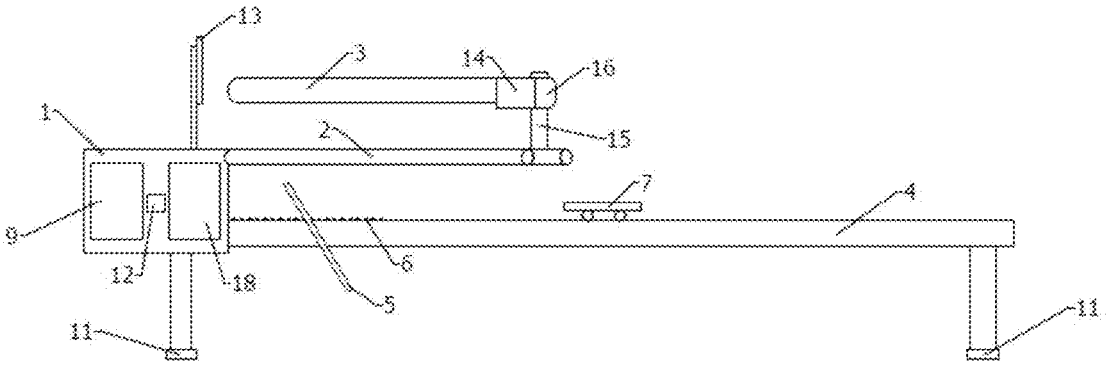

[Fig. 3]
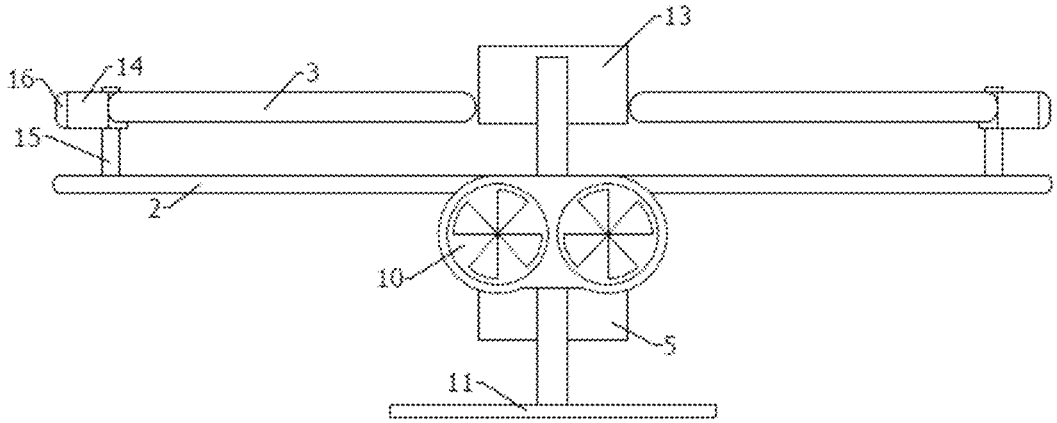
[Fig. 4A]
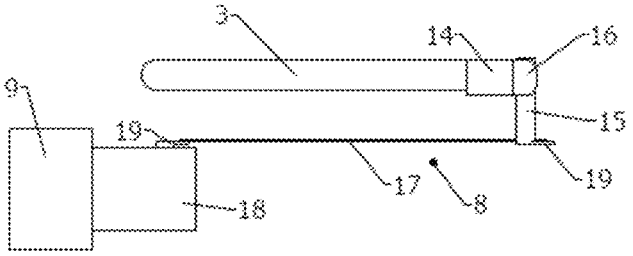
[Fig. 4B]
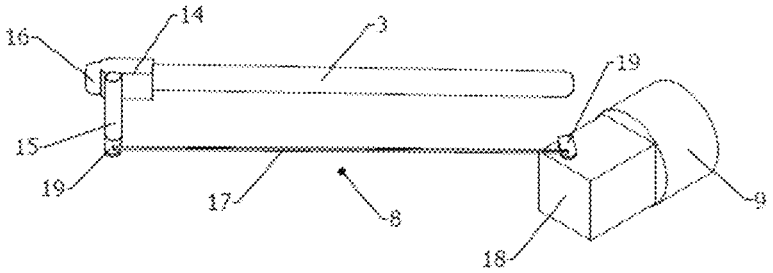

[Fig. 4C]
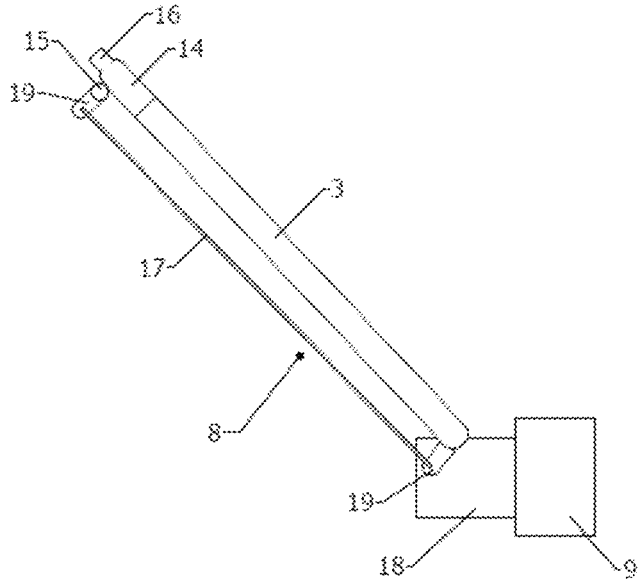

SCULLING SIMULATOR

CROSS REFERENCE TO RELATED APPLICATIONS

This application is the National Stage of PCT/CZ2023/050041 filed on Jul. 13, 2023, which claims priority under 35 U.S.C. § 119 of Czech Republic Application No. PV 2022-308 filed on Jul. 14, 2022, the disclosure of which is incorporated by reference. The international application under PCT article 21(2) was not published in English.

FIELD OF THE INVENTION

The invention relates to the field of sports machines and simulators, more particularly rowing machines and simulators, more particularly sculling simulators with two oars designed to realistically simulate rowing training and racing.

PRIOR ART

Currently, there are rowing machines that are used by athletes all over the world. However, these machines do not achieve the level of compliance with the rowing motion on the boat that would be required. This is due to their technical limitations and the simplification of the mechanical operation of these machines.

The current rowing machines are in their majority a trainer equipped with an air resistance fan that is connected to a continuous chain, at the end of which is a bar attached in its center (shown in US design USD367508S). The bar serves as an imitation of oars and athletes hold it on its ends; when the bar is pulled the air resistance fan blades spin and create the necessary resistance. However, it is this bar that significantly limits the rower's movement compared to the movement on the rowing boat. The rowers keep their hands on the bar in one place, far apart, but this is not the case on the boat. Also, the connection to a single resistance fan does not correspond to the two blades of the oar that the rower has on the boat.

Alternative embodiments include a magnetic resistance mechanism, but even with these embodiments, one common resistance mechanism is used for both hands of the rower.

Although rowing machines with oars are disclosed in the patent literature (e.g. patent applications published under numbers WO 2014/179866 A1, EP 2 545 965 A2, US 2006/0270528 A1, US 2011/0245044 A1, WO 97/22389), these rowing machines are still severely limited by the use of a single resistance mechanism that is common and merged for both oars, where the rower does not feel the correct dynamics of the movement of each arm separately, as would be the case on a boat.

The current machines are mainly used for winter training, but due to their imperfect technical design, rowers lose their trained movement technique, and when they go out to train on boats again after the winter season, they have to regain this previously trained movement again hard. With the current machines, athletes also do not achieve the same stretching of the pectoral muscles as on the boat, while at the same time the movement of the shoulder joint is also limited.

The present invention is an improved sculling simulator that allows realistic training of all movements, including the coordination of the movements of both arms required subsequently when rowing in a boat, thus eliminating the shortcomings of the rowing simulators used to date.

SUMMARY OF THE INVENTION

The present invention relates to a sculling simulator comprising a base, a slide rail to which a foot stretcher is adjustably mounted and a movable seat is mounted, a pair of wings attached on their front side to the base of the simulator, each wing having an oar pivotally attached to the other side, each oar being connected by its own transmission system to its own resistance fan.

Sculling is rowing where each rower has two oars. The disciplines of sculling include single scull, double scull, paired four or the unconventional paired eight.

For the purposes of this application, the terms simulator and trainer are considered to be partial synonyms referring to a machine on which rowing can be practiced on land, with the proviso that the simulator means a machine with a greater degree of realism and similarity to actual training on the water.

The sculling simulator according to the present invention is typically planarly symmetric, with the plane of symmetry running the length of the machine through the middle of the slide rail.

The base of the simulator serves both as a stabilizing element and for housing at least a portion of the transmission system and resistance fans and for mounting the wings. It can be in the form of a housing or cage, ideally metal for greater weight and thus stability. The base can be placed both in front of and behind the athlete. It is preferable to place the base in front of the athlete.

The slide rail passes through the center of the simulator and is firmly attached to the base of the simulator on one side. The fixing can be by welding or by screws.

In one preferred embodiment, the slide rail is composed of two or more parts, wherein these parts can be collapsed for easier handling and storage of the simulator.

A foot stretcher (i.e. supports for the athlete's footwear) is mounted to the slide rail in an adjustable manner. The position of the foot stretcher is adjustable, for example, by a ladder structure attached to the front of the slide rail, which is positioned immediately behind the base when the base is in front of the athlete.

This part is then followed by a running part of the slide rail, which is designed to hold and move the seat. The seat consists of a rowing, ergonomically shaped seat and a device allowing smooth movement along the slide rail. This device may be, for example, castors or rollers. Restrictions on the movement of the seat are provided by stops—one located behind the ladder structure, the other at the opposite end of the slide rail. The stops may be, for example, in the form of a bolt fitted with a rubber cap on the upper side.

The wings are the non-moving part of the machine during training. One wing comes out of each side of the base. The wings are placed symmetrically, each pointing to one side from the base. The wings are fixed at one end to the base of the machine. They form an acute angle with the plane of the slide rail. They are typically fixed at an angle of approximately 45° to 50°. The outer structure of the wing may consist, for example, of a pair of tubes (e.g. aluminium, steel or composite). Means (parts of) of the transmission system for transferring power from the oar to the resistance fan are housed inside the wings. The wings may also be provided with a cover (for example plastic) to prevent dust or other small particles from clogging the rods. In one embodiment, the wings can be folded towards the slide rail of the simulator during handling, and the simulator then takes up considerably less space.

To each of the wings, at the other end, an oar is pivotally attached, the oar being specially shortened (compared to the standard oar used on rowing boats), i.e. without a blade. The oar can be equipped with a rubber sleeve at its free end, which serves for a better grip of the oar and prevents the oar from slipping in the hand of an athlete.

Each oar is then connected by its own transmission system with its own resistance fan.

In a preferred embodiment, the resistance fan is an air resistance fan with a resistance regulator.

The air resistance fan provided with a resistance regulator may be enclosed in a perforated base cage to make air leakage more difficult and to allow adjustment of the resistance by regulating the amount of air that enters through the regulator grid. The resistance in the fans is created by the rotating blades and is controlled by the amount of air admitted into the fan.

The transmission system transfers the force exerted by the athlete by turning the oar further into the resistance fan. The transmission system means the entire apparatus from the pivot of the oar and the wing to the air resistance fan. The transmission system may include various elements such as axles, rods, levers, rod and gear sets, planetary gears, etc.

As noted, each oar has its own associated transmission system and its own resistance fan. Thus, the resistance felt by the athlete on each arm is authentic and can vary according to the athlete's capabilities and abilities, just as on a boat. These differences between one fan and the other can be measured and compared in the computer in front of the athletes so that they can keep track and improve their performance.

Typically, the transmission system and resistance fan for a given oar will be located on the same side as the oar. This means that the transmission system and resistance fan for the left oar will be located on the left side of the simulator, while the transmission system and resistance fan for the right oar will be located on the right side of the simulator.

In one preferred embodiment, each oar is connected to its wing via an oarlock and an axle. The oar is inserted into the oarlock which provides three basic functions: lever action of the oar, rotation of the oar and transmission of power to the axle. The force is therefore transmitted from the oar through the oarlock and the axle. The wing also houses steel, aluminium or composite rods which transfer the force from the oars via the lever to the base of the machine where the gearboxes and resistance fans are located.

In one preferred embodiment, the axle is longitudinally perforated to adjust the height of the oarlock and therefore the oar by locking the oarlock in position. This achieves a more comfortable hold on the oar for athletes of different heights.

In a further preferred embodiment, each oar is further connected to the oarlock by a spring system which takes care of balancing the weight of the oar and simulating the water surface.

In a further preferred embodiment, the simulator also comprises two stands that are located under the slide rail and the base (one at the rear and one at the front) to allow the simulator to be positioned and manipulated. Alternatively, it is possible to mount the entire simulator in rails that are standardly used to mount rowing machines. The stands, or just one of them (the rear one), may advantageously be sprung, which further simulates the movement of the boat.

In one preferred embodiment, the simulator further comprises a control unit comprising sensors, a processor and a memory module. The processor collects data from the sensors regarding the transmitted forces, further stores the data in the memory module, and evaluates the data and can further provide the data to the athlete.

An alternative to a fixed control unit is transmitting the data from the simulator sensors directly to an external mobile device (smartphone or tablet) of the athlete, where the data is processed and stored by the processor and memory module of the mobile device. The mobile device is connected to the simulator via wireless technology such as Bluetooth. In this way, the athletes always have the data for immediate analysis on their device, whatever simulator they are using. At the same time, they can share this data with their coach, within their team, etc.

In another preferred embodiment, the simulator further comprises a touch screen display. The touch screen display allows for user setup of the simulator (e.g., setting the duration of the training session, etc.) and also provides the user with data regarding their athletic performance as processed by the processor. As a result of the distribution of oars and fans, it is possible to display a different stroke by each oar, which is important for practicing holding a straight line, something that especially younger or less experienced rowers have trouble with during races.

CLARIFICATION OF DRAWINGS

FIG. 1 is a schematic view of the simulator from above.

FIG. 2 is a schematic view of the simulator from the side.

FIG. 3 is a schematic view of the simulator from the front.

FIG. 4A, FIG. 4B and FIG. 4C are schematic representations of the transmission system.

EXAMPLES OF EMBODIMENTS OF THE INVENTION

It is to be understood that the examples described below are for illustrative purposes only and are not intended to limit the invention to these examples. Certainly, a person skilled in the art will be able to prepare equivalents to the specific embodiments of the invention described herein by means of routine experimentation. These equivalents are also included within the scope of protection defined by the following patent claims.

Example 1

A sculling simulator comprises a solid base 1 in the form of a metal housing positioned in front of an athlete. The base 1 houses two gearboxes 18 in the form of gear sets and two air resistance fans 2 with a resistance regulator 10. The resistance of the fans 9 can be adjusted by mechanically opening or closing the grid of the regulator 10.

A slide rail 4 is firmly attached to the base 1. A ladder structure 6 for adjustable attachment of a foot stretcher 5 is provided at the slide rail 4 near the base 1. The continuing part of the slide rail 4 is bare and a seat 7 in the form of a rowing, ergonomically shaped seat fitted with castors for smooth movement of the seat Z along the slide rail 4 is attached thereto. The limitation of the range of movement of the seat Z is secured by stops in the form of bolts provided on their upper side with rubber caps—one stop being located behind the ladder structure 6, the other at the opposite end of the slide rail 4.

Attached to the base 1 is a pair of wings 2, each at an angle of 45° from the plane of the base 1, each pointing to the opposite side from the base 1. The wings 2 are formed by a pair of aluminium tubes which form the reinforcement of the wings 2 and a space in the middle in which is located a steel rod 17 which transmits the force from the oars 3 via a lever 19 to the gearbox 18.

To each of the wings 2 an oar 3 is pivotally attached by an oarlock 14 and an axle 15, the oar 3 being provided at its free end with a rubber sleeve for better gripping the oar 3. A steel rod 17 in the wing 2 is connected to the axle 15 via a lever 19. A spring system 16 is attached to the oar 3 at the end of the oarlock 14 to compensate for the weight of the oar 3 and to simulate the water surface.

Each oar 3 is connected by means of a transmission system 8 in the form of an oarlock 14, an axle 15, a rod 17, levers 19 and its own gearbox 18 with its own resistance fan 9. The transmission system 8 and resistance fan 9 for the left oar 3 are located in the left part of the simulator, the transmission system 8 and resistance fan 9 for the right oar 3 are located in the right part of the simulator.

Two metal stands 11 are attached to the simulator by means of screws, one in the part below the beginning of the slide rail 4 at the base 1 of the simulator, the other at the opposite free end of the slide rail 4.

Example 2

A sculling simulator comprises a solid base 1 in the form of a metal housing positioned in front of an athlete. The base 1 houses two gearboxes 18 in the form of gear sets and two air resistance fans 2 with a resistance regulator 10. The resistance of the fans 2 can be adjusted by mechanically opening or closing the grid of the resistance regulator 10.

A slide rail 4 is firmly attached to the base 1. A ladder structure 6 for adjustable attachment of a foot stretcher 5 is provided at the slide rail 4 near the base 1. The continuing part of the slide rail 4 is bare and a seat 7 in the form of a rowing, ergonomically shaped seat fitted with castors for smooth movement of the seat Z along the slide rail 4 is attached thereto. The limitation of the range of movement of the seat Z is secured by stops in the form of bolts provided on their upper side with rubber caps—one stop being located behind the ladder structure 6, the other at the opposite end of the slide rail 4.

Attached to the base 1 is a pair of wings 2, each at an angle of 47° from the plane of the base 1, each pointing to the opposite side from the base 1. The wings 2 are formed by a pair of steel tubes which form the reinforcement of the wings 2 and a space in the middle in which is located a steel rod 17 which transmits the force from the oars 3 via a lever 19 to the gearbox 18. The wings 2 are equipped with a plastic cover to prevent the rods 17 from becoming clogged with dust or other small particles.

To each of the wings 2 an oar 3 is pivotally attached by an oarlock 14 and an axle 15, the oar 3 being provided at its free end with a rubber sleeve for better gripping the oar 3. A steel rod 17 in the wing 2 is connected to the axle 15 via a lever 19. A spring system 16 is attached to the oar 3 at the end of the oarlock 14 to compensate for the weight of the oar 3 and to simulate the water surface.

Each oar 3 is connected by means of a transmission system 8 in the form of an oarlock 14, an axle 15, a rod 17, levers 19 and its own gearbox 18 with its own resistance fan 9. The transmission system 8 and resistance fan 9 for the left oar 3 are located in the left part of the simulator, the transmission system 8 and resistance fan 9 for the right oar 3 are located in the right part of the simulator.

Two metal stands 11 are attached to the simulator by means of screws, one in the part below the beginning of the slide rail 4 at the base 1 of the simulator, the other at the opposite free end of the slide rail 4. This rear stand 11 is sprung, which simulates the movement of the boat on the water.

The simulator is further provided with a control unit 12 having a processor and a memory module and a touch screen display 13. The processor processes the data on the transmitted forces and further stores the data on the memory module. Intermediate and overall training data is displayed on the touch screen display 13. This data includes speed data, number of strokes per minute, difference in stroke between the left and right oars, including visualization of any turning due to unequal oar stroke. The touch screen display 13 also allows for user adjustments to the simulator, such as setting the duration of the training session, etc.

Example 3

A sculling simulator comprises a solid base 1 in the form of a metal cage positioned behind an athlete. The base 1 houses two gearboxes 18 in the form of gear sets and two air resistance fans 2 with a resistance regulator 10. The resistance of the fans 2 can be adjusted by mechanically opening or closing the grid of the resistance regulator 10, controlled manually.

A collapsible slide rail 4 consisting of two parts is bolted to the base 1. A ladder structure 6 for adjustable attachment of a foot stretcher 5 is provided at the slide rail 4 at the opposite side from the base 1. The continuing part of the slide rail 4 is bare and a seat 7 in the form of a rowing, ergonomically shaped seat fitted with rollers for smooth movement of the seat 7 along the slide rail 4 is attached thereto. The limitation of the range of movement of the seat 7 is secured by stops in the form of bolts provided on their upper side with rubber caps-one stop being located behind the ladder structure 6, the other at the opposite end of the slide rail 4.

Attached to the base 1 is a pair of wings 2, each at an angle of 45° from the plane of the base 1, each pointing to the opposite side from the base 1. The wings 2 are formed by an aluminium profile which forms the reinforcement of the wings 2 and a space in the middle in which is located a steel rod 17 which transmits the force from the oars 3 via a lever 19 to the gearbox 18.

To each of the wings 2 an oar 3 is pivotally attached by an oarlock 14 and an axle 15, the oar 3 being provided at its free end with a rubber sleeve for better gripping the oar 3. A steel rod 17 in the wing 2 is connected to the axle 15 via a lever 19. A spring system 16 is attached to the oar 3 at the end of the oarlock 14 to compensate for the weight of the oar 3 and to simulate the water surface. The axle 15 connecting the wing 2 and the oar 3 is perforated for height adjustment of the oar 3.

Each oar 3 is connected by means of a transmission system 8 in the form of an oarlock 14, an axle 15, a rod 17, levers 19 and its own gearbox 18 with its own resistance fan 9. The transmission system 8 and resistance fan 2 for the left oar 3 are located in the left part of the simulator, the transmission system 8 and resistance fan 9 for the right oar 3 are located in the right part of the simulator.

Two metal stands 11 are attached to the simulator by means of screws, one in the part below the beginning of the slide rail 4 at the base 1 of the simulator, the other at the opposite free end of the slide rail 4. This rear stand 11 is sprung, simulating the movement of a boat on the water. The simulator is further mounted in standard rails used for rowing machines.

The simulator is further provided with a control unit 12 having a processor and a memory module and a touch screen display 13. The processor processes the data on the transmitted forces and further stores the data on the memory module. Intermediate and overall training data is displayed on the touch screen display 13. This data includes speed data, number of strokes per minute, difference in stroke between the left and right oars, including visualization of any turning due to unequal oar stroke. The touch screen display 13 also allows for user adjustments to the simulator, such as setting the duration of the training session, etc.

INDUSTRIAL APPLICABILITY

The sculling simulator according to the present invention brings improvement in winter training and racing and realistic training of movements used in real boat rowing. It will be particularly useful for rowing clubs, associations and organizers of rowing competitions. It will also find its use in gyms. The use of oars in indoor rowing training is more fun in contrast to the bar on current machines. Athletes after winter training will smoothly move to boats and will achieve better performances because their training will not be disturbed by the change of movement.

Children, complete novices and top athletes preparing to represent their countries in international competitions can learn and train rowing on the simulator. The machines are also designed for racing. The simulator is designed to visually match as closely as possible the shape and curves of rowing boats, and thus have a better effect on the psyche of athletes.

The main advantages of the sculling simulator according to the present invention include, in particular, the faithful simulation of all movements in the boat, whereby the movement of the athletes' shoulder joint is not limited and their muscles can be stretched in the same way as in the boat. At the same time, it allows coaches to observe whether the athletes hold the oars correctly in their hands and pull them properly against their body, thus maximizing the execution of the rowing movement even subsequently in the summer season during boat racing. Therefore, athletes do not have to train hard again after winter training to get the correct rowing motion back and just switch to boats.

The simulator can be used not only for winter training, but also in clubs that have, for example, limited access to the water only on designated days, while training must be carried out more often than the possibilities of training on the water.

LIST OF REFERENCE NUMERALS

1 . . . base
2 . . . wing
3 . . . oar
4 . . . slide rail
5 . . . foot stretcher
6 . . . ladder structure for adjustable foot stretcher attachment
7 . . . seat
8 . . . transmission system
9 . . . resistance fan
10 . . . resistance regulator
11 . . . stand
12 . . . control unit
13 . . . touch screen display
14 . . . oarlock
15 . . . axle
16 . . . spring system
17 . . . rod
18 . . . gearbox
19 . . . lever

The invention claimed is:

1. A sculling simulator comprising a base, a slide rail to which a foot stretcher is adjustably mounted and a movable seat is mounted, a pair of wings fixedly attached at their front side to the base of the simulator, each of the wings having an oar pivotally attached to an other side, wherein each oar is connected by its own transmission system to its own resistance fan, wherein the resistance fans and at least parts of the transmission systems are located in or on the base, wherein the oar is connected to the wing by an oarlock and an axle, and wherein the axle is longitudinally perforated for height adjustment of the oar.

2. The sculling simulator according to claim 1, wherein the resistance fan is an air resistance fan with a resistance regulator.

3. The sculling simulator according to claim 1, wherein the oar is further connected to the oarlock by a spring system.

4. The sculling simulator according to claim 1, wherein the slide rail is composed of two or more parts and is collapsible.

5. The sculling simulator according to claim 1, wherein the sculling simulator further comprises two stands located under the slide rail and the base.

6. The sculling simulator according to claim 5, wherein at least one of the stands is sprung.

7. The sculling simulator according to claim 1, wherein the sculling simulator further comprises a control unit.

8. The sculling simulator according to claim 1, wherein the sculling simulator further comprises a touch screen display (13).

9. A sculling simulator comprising a base, a slide rail to which a foot stretcher is adjustably mounted and a movable seat is mounted, a pair of wings fixedly attached at their front side to the base of the simulator, each of the wings having an oar pivotally attached to an other side, wherein each oar is connected by its own transmission system to its own resistance fan, wherein the resistance fans and at least parts of the transmission systems are located in or on the base, wherein the oar is connected to the wing by an oarlock and an axle, and wherein the oar is further connected to the oarlock by a spring system.

10. The sculling simulator according to claim 9, wherein the resistance fan is an air resistance fan with a resistance regulator.

11. The sculling simulator according to claim 9, wherein the slide rail is composed of two or more parts and is collapsible.

12. The sculling simulator according to claim 9, wherein the sculling simulator further comprises two stands located under the slide rail and the base.

13. The sculling simulator according to claim 12, wherein at least one of the stands is sprung.

14. The sculling simulator according to claim 9, wherein the sculling simulator further comprises a control unit.

15. The sculling simulator according to claim 9, wherein the sculling simulator further comprises a touch screen display.

* * * * *